US005996791A

United States Patent [19]

Bibby et al.

[11] Patent Number: 5,996,791

[45] Date of Patent: Dec. 7, 1999

[54] CURTAIN ROD SYSTEM

[75] Inventors: Keith M. G. Bibby, Mansfield, Mass.; Robert H. Hesford, Wakefield, R.I.

[73] Assignee: Kenney Manufacturing Co., Warwick, R.I.

[21] Appl. No.: 09/138,334

[22] Filed: Aug. 21, 1998

[51] Int. Cl.[6] ..... B65D 65/38; B65D 73/00

[52] U.S. Cl. ..... 206/326; 40/673; 206/459.5; 206/497

[58] Field of Search ..... 40/662, 665, 672, 40/673, 675; 206/231, 232, 321, 325, 326, 442, 459.5, 497; 211/105.3

[56] References Cited

U.S. PATENT DOCUMENTS

| | | | |
|---|---|---|---|
| 2,170,570 | 8/1939 | Moriarity | 206/231 |
| 2,285,600 | 6/1942 | Maves | 206/326 |
| 2,374,881 | 5/1945 | Murphy et al. | 206/326 |
| 3,131,811 | 5/1964 | Miller | 206/326 |
| 4,976,301 | 12/1990 | Easley et al. | 206/326 |

*Primary Examiner*—Jim Foster

*Attorney, Agent, or Firm*—Robert J. Doherty

[57] ABSTRACT

A composite package including a two-part assembled curtain rod provided with a closely contacting plastic film covering that has been shrink wrapped thereover along with a unique merchandising tag that is used with the composite package as well as the procedure of forming the package which includes the step of enveloping and forming the shrink wrap covering over the assembled rod prior to forming the rearwardly extending legs of the curtain rods.

10 Claims, 10 Drawing Sheets

CURTAIN ROD SYSTEM

BACKGROUND AND OBJECTS OF THE INVENTION

This invention relates to curtain rods and more particularly to a merchandising system including novel packaging by which the curtain rods are displayed for sale. The system involves two-piece curtain rods of the type having first and second members which telescope with respect to each other so as to provide a range of lengths for each rod. Each rod member is also generally provided with an angled bend at opposite ends of the respective members which ends form opposed legs which generally extend from the curtain rod body at right angles thereof. These legs are then provided with openings or other means by which the rod can be suspended from a pair of longitudinally separated brackets. Generally, each of the component members of the rod are each from an elongated piece of metal stock extruded or bent into a generally C-shape cross-sectional configuration and individually sized such that one of the members may be telescoped with respect to the other member. The surface of the metal components are provided with a protective paint surface and although generally constructed of metal as above indicated, could be formed from other materials such as plastic.

The brackets that are normally associated with the suspension of such curtain rods are also generally formed from bent metal sheets and include a base plate adapted to abut the wall or other mounting surface and a forwardly extending tongue terminating in a forward end configured so as to present appropriately shaped tabs and cutouts for receipt of the terminal portions of the rearwardly extending legs of the curtain rods which in turn are provided with attachment means for the brackets (normally a pair of vertically spaced holes). When using such brackets and curtain rods to accomplish the separate hanging of both curtains and a forwardly projecting valance, it is necessary to provide two separate curtain rods—one with legs provided with a greater rearward extent, e.g., valance rods having three-inch rearwardly extending legs and conventional rods having two-inch rearwardly extending legs. The curtains or sheers are placed on one pair of brackets mounted inwardly of an outer pair of brackets to accomplish the intended aesthetic effect. This requires that two separate curtain rods in various lengths, styles and colors must be desirably provided at the point-of-purchase sales display so that the consumer once deciding upon a style can make an immediate purchase rather than ordering the goods which sometimes results in lost sales. This stockage requirement, however, obviously takes up valuable space at point-of-purchase displays which is undesirable from the merchandiser's standpoint. It, accordingly, would be extremely desirable to be able to have a curtain rod system which eliminates the need for curtain rods having two different leg dimensions.

In connection with conserving space at point-of-purchase displays in retail stores, it has also been known to provide open bins in which the curtain rods are placed horizontally in contrast to being packaged in plastic bags in turn provided with cardboard headers and vertically suspended from peg board displays in seriatim positioning one behind the other. Such packaging of curtain rods, either singly or doubly in cases where a valance treatment is desired, within such plastic bags is, however, not without its drawbacks in that large groups of such plastic bags tend to slip about, are more difficult to grasp and easily spill on the floor. It, accordingly, would be desirable to be able to package curtain rods in such a way that they are more easily grasped when placed into such bins and still protected by a plastic covering or envelope and also easily capable of being labeled such that the consumer can easily look in the bin and determine the style, dimensions and coloring thereof.

A still further consideration of these sales and display programs whether involving bins or not is the packaging space required to ship the completed curtain rod or curtain rods in their conventional loose plastic bags. These bags are in turn provided with top positioned headers for a suspended point of display when desired as opposed to a bin display. The bag headers thus require that a somewhat larger container be utilized when shipping from the manufacturer to the merchandise store which when considering the high number of such units shipped can, over time, amount to a considerable expense and waste of cardboard. It would, accordingly, be desirable to be able to reduce the size of the shipment box necessary but still be able to provide a point-of-sale label or tag suitable for both utility in a bin sales program as well as in a rod display program which involves the suspending of curtain rods upon peg board hooks or rods as previously discussed.

These and other objects of the present invention are accomplished by the cooperative effects of providing a curtain rod construction fully or at least essentially fully enveloped in a tight plastic package as contrasted from storage in a loose fitting plastic envelope or bag which when coupled with a novel bracket construction including dual forwardly extending suspension tongues of differing dimension such that a single curtain rod having the standard two-inch leg projection can not only be utilized for both valance and curtain treatments simultaneously in the same installation but furthermore materially reduces the inventory and space needed for satisfactory display of the curtain rod products. Similarly, a curtain rod so packaged as above explained can be provided with a frictionally movable information and legend tag that can be positioned intermediate the rod ends for bin display and proximate to one leg of the rod when serial front to rear suspension on peg board hooks is desired.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
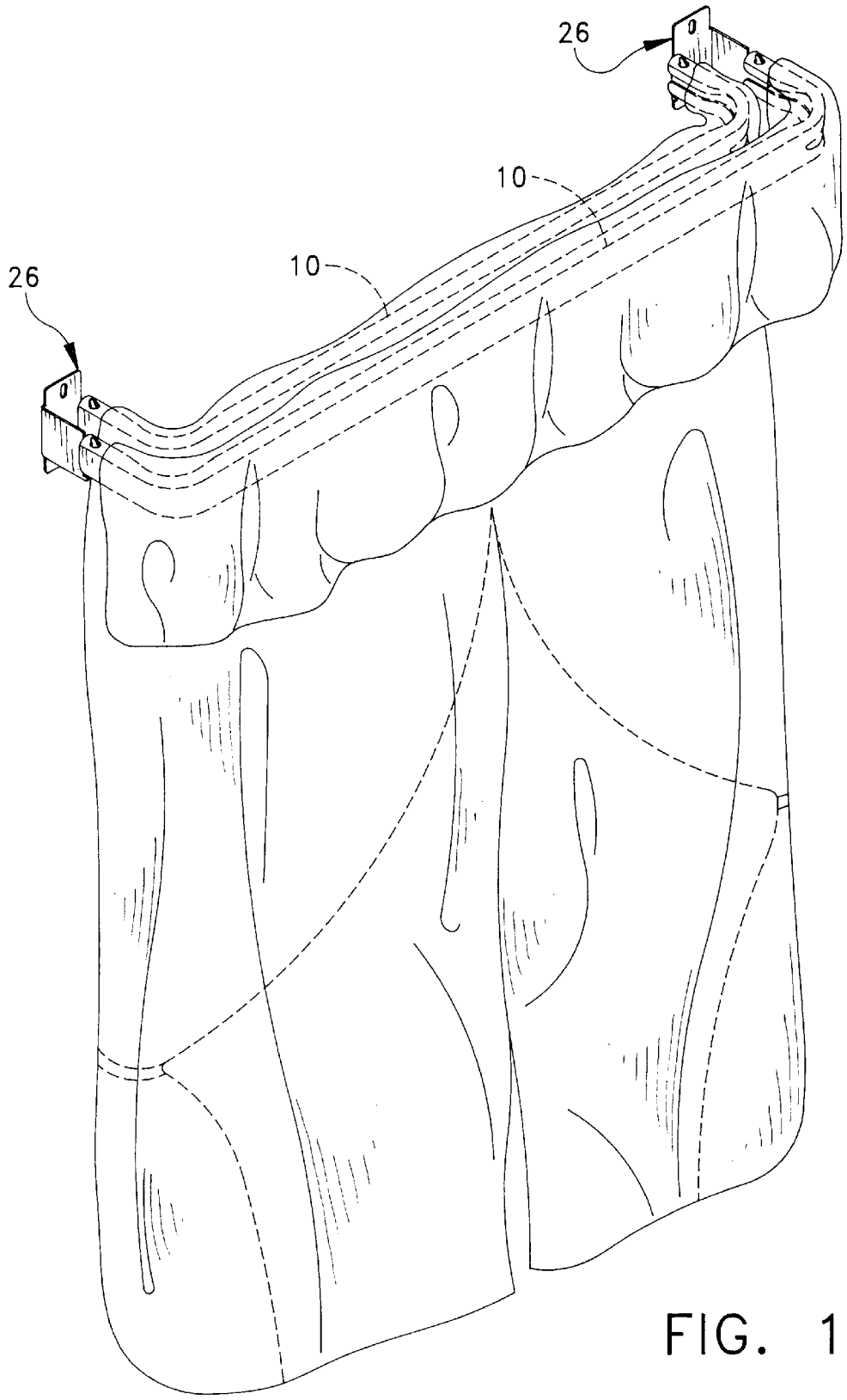
FIG. 1 is a perspective view showing the dual curtain and valance treatment commonly used in decorating but showing the manner in which the present invention can be utilized to eliminate the need for curtain rods having multiple sized legs.
Figure 2:
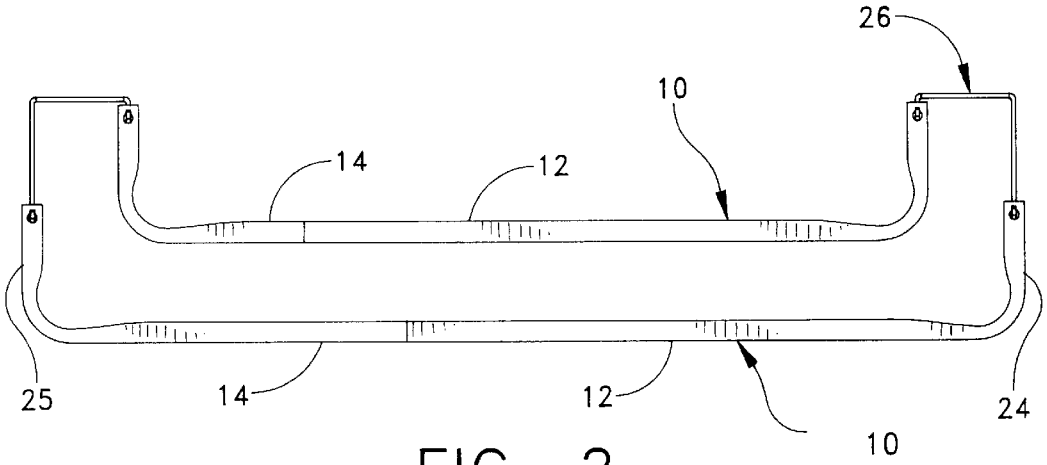
FIG. 2 is a top view of FIG. 1.

Turning now to the drawings and particularly FIG. 1 thereof, a stylized treatment for windows is shown in which a first or inner curtain rod suspends a pair of curtains or sheers and a second or outer curtain rod suspends a short skirt or valance at the top and forwardly thereof. Normally in order to achieve this decorative window treatment, the rearwardly extending ends of each of the curtain rods shown in FIG. 1 extend towards the mounting surface or brackets different distances. The legs of the inner curtain rod utilized for the sheers would extend the conventional two inches while the curtain rod utilized for the valance would incorporate legs which extend rearwardly three inches such that when placed on two separate bracket pairs there would be a forward separation or span of one inch between the longitudinal runs of the curtain rods.

In the present invention, the curtain rod 10 comprises a first member 12 and a second member 14 which is adapted to telescope into inner open end 16 of the first member. In that respect, it should be pointed out that each of the members 12 and 14 include inner ends 16 and 18 respectively and outer ends 20 and 22 respectively—the outer ends, in fact, terminating in rearwardly extending legs 24 which in the case of the present construction are of the same extent (normally two inches).

Figure 3:
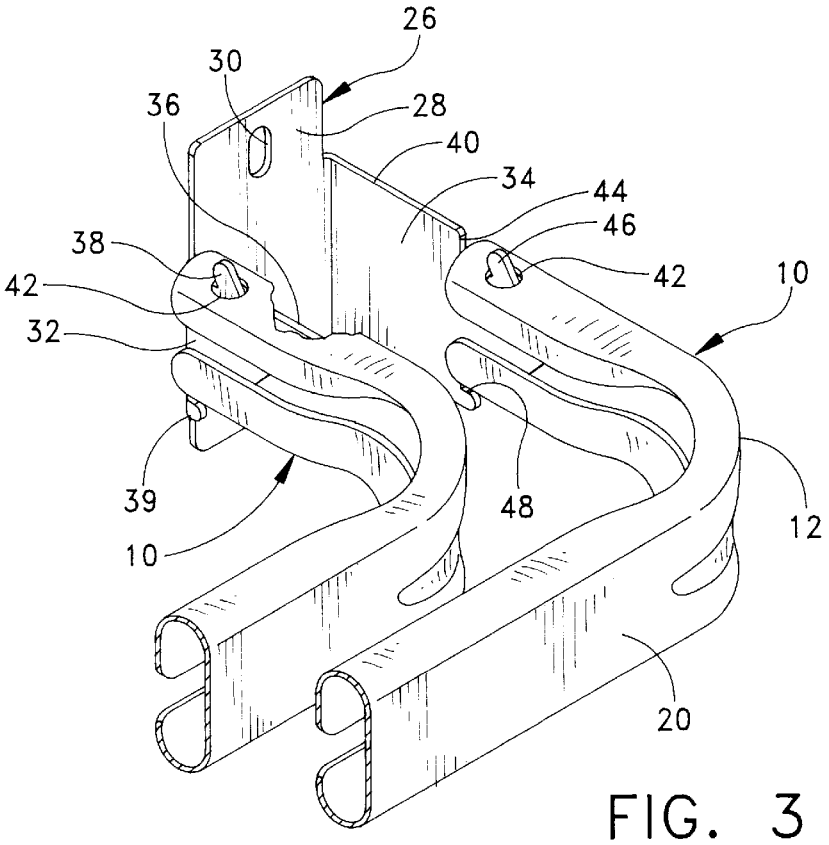
FIG. 3 is a partial perspective view of FIG. 1 and in particular shows the dual forwardly extending wall bracket tongues utilized to position the ends of two identical range sized and shaped curtain rods so as to accomplish the design appearance shown in FIG. 1 without the use of curtain rods having two different leg lengths, i.e., two inches and three inches.

The present invention is directed to a novel bracket construction as shown in FIG. 3 which eliminates the need for the second or outer curtain rod to be dimensioned with a longer leg extent, e.g., three inches, for the valance treatment shown in FIG. 1. In the present instance, such brackets 26 are sold in pairs generally with one of the curtain rods of the present invention although in some cases when wider than normal lateral separation between the curtain and valance rods is necessary could be sold such that each rod has its own bracket pair.

In essence then, each bracket 26 includes a base plate 28 generally of planar construction and having fastening holes 30 by which the base plate 28 rear wall may be affixed to the mounting surface, e.g., woodwork surrounding a window or the wall. Forwardly extending from the forward surface of the base plate 28 are first and second forwardly projecting tongues 32 and 34. The first tongue 32 is of a conventional forward extent, e.g., about one-half inch, and includes and upper edge 36 having an upwardly projecting tab 38 for receipt into one of the openings or holes 42 provided in the upper wall of the curtain rod legs 24 and a lower extension or slot 39 which the lower terminal wall of one of the legs 24 contacts. This relative connection means is conventional in the art. The other or second tongue 34 extends forwardly a greater distance than tongue 32, e.g., for a total of one and half inches or a one inch further extension than the inner tongue. The second tongue also includes an upper edge 40, a cutout portion 44, an upwardly extending tab 46 and a slot 48 for capturing the curtain rod leg in the known manner. Thus by providing a bracket which has two tongues of differing forward extent, the ability of a pair of rods identically dimensioned which when mounted to bracket 26 enables accomplishing a curtain and valance treatment such as shown in FIG. 1 that ordinarily would have to be achieved by curtain rods having differing leg lengths. In this manner then, the bracket and rod combination of the present invention eliminates the necessity of stocking two different leg lengths and the attendant increased space and sales complexity required by such different rods.

The bracket pair or pairs as may be desired can be separately sold in a nearby adjacent location. The use of the novel bracket of the present invention enables not only the reduction in inventory and sales space described above but further enables the one-size curtain rod to be packaged in a novel manner with even further attendant advantages. This novel packaging is best shown by particular reference to FIGS. 4 and 14 and the procedures by which such may be formed in FIGS. 5 through 11. Therein it may be readily apparent that the curtain rod 10 as previously indicated includes a first member 12 and second member 14. Such rod 10 except as will be hereinafter indicated are of conventional construction and normally formed of a cold rolled steel stock that is curled into a C-shaped cross-sectional configuration and dimensioned such that the first rod member 12 is of a slightly larger cross-sectional extent than that of the second rod member 14 so that the second rod member 14 may slide inside the inner open end 16 of the first rod member 12. Rod member 12 is formed with a planar front face 20 with partial upper and lower rear walls 50 and 52 respectively and a pair of inwardly extending legs 24 and 25 respectively at the outer terminal portions of each rod member, that is, leg 24 is formed at the terminal end of the first rod member 12 while leg 25 is formed at the outer terminal end of the second rod member 14. The holes 42 as previously explained are generally initially punched into the flat stock from which the rod members 12 and 14 are formed by conventional metal forming techniques and, accordingly, are positioned in the upper and lower partial rear walls of the rod members for receipt of the bracket tongues regardless of the particular orientation of the completed rod with respect thereto.

The inner open end 16 of the first rod member 12 is also often sized slightly larger than is necessary to receive the inner open end 18 of the second rod member so as to enable easy assembly of the two pieces together. Furthermore, it is common to provide open end 18 of the second member 14 with a forwardly projecting edge 54 as, in effect, a lead into the open end 16 of the first rod member. Such dimensioning while useful in assembly of the rod often can lead to an inherent weakness as when the rod members 12 and 14 are angularly flexed in opposite directions within the plane of their front walls especially when such flexing or stress occurs when they are in fully or close to fully extended positioning. It is common to provide a strengthening ring or grommet which is threaded over either of the outer ends of the composite rod and then positioned over the tab portions 56, 58 which form the terminal end portions of the rear walls of the inner open end of the first rod member 12 to, in effect, reduce or eliminate the above described tendency of these tab portions or flaps 56, 58 to outwardly separate from each other thus opening the extent of the inner open end 16 to a point where failure might occur. Such grommets are normally made of plastic or rubber-like material and of a dimension closely conforming to that of the outside of the rod member 12 and include a body 62 of a lateral extent to assure easy spanning of the point of overlap or joinder 64 between the respective inner end 16 and 18 of the rod members. The spreading or opening of such tabs 56, 58 caused by the lateral bending described above can in a considerable number of cases present difficulty in threading the ring 60 over the joinder area 64 especially if threaded from the direction of the second rod member 14 towards the joinder 64 and part of this invention as will hereinafter be explained is to assure the tight conformation of such tab portions or flaps 56, 58 to their intended generally C-shaped cross-sectional configuration and in close conformity to the underlying walls of the telescoped second rod member 14.

Presently, it is common in the art to individually form the legs 24, 25 on the first and second rod members 12 and 14 respectively prior to placing such rod members in telescoped condition for a number of historic reasons including the chance the telescoped position of the second rod member within the first could change during forming and result in damage not only to the work piece but also the dies utilized in the standard metal roll forming techniques utilized to make the appropriate bends to form such legs. A number of attendant advantages can, however, be accomplished by forming the legs after telescoping the members 12 and 14 and by initially enveloping the assembled rod members 12, 14, that is, in telescoped relationship, within a shrink wrapped plastic envelope 70 which tightly conforms to all the outer surfaces of the telescoped but unbent (at least with respect to the formation of the legs 24 and 25) rod members.

Accordingly, a unique feature of the present invention is not only the use of a plastic shrink wrap covering to maintain the desired telescope position of the two rod members with respect to each other but the stage at which such shrink wrap is applied in the production cycle, that is, prior to the forming of the rod member terminal legs. Generally in such shrink wrap procedures, an oriented sheet or envelope 70 of clear or at least see-through plastic resinous material is placed over the article to be packaged or conversely the article to be packaged placed into the envelope 70 and thereafter such preliminarily finished package subjected to heat such that the resinous plastic material shrinks and forms a tight covering over the contained article in this case the inner surfaces 74 of the sheet or envelope 70 coming in close almost skin-like contact with the outer surfaces of the telescoped rod, that is, the front and rear walls of the first rod member as well as those portions of the second rod member that extend beyond the joinder 64 as well as the outer ends 20 and 22. In essence, the shrink wrap process provides an almost skin-like covering 72 to this intermediate rod package. It should be pointed out that this shrinkage process exerts a considerable force and could through inward shrinkage of the sheet, envelope or wrap pushing against the ends 20 and 22 undesirably inwardly telescope the rod members to a greater degree than desired. In order to prevent this occurrence, stop means are provided in the body of the first rod member 12 such that the forwardly extending portions of the open end 18 of the second rod member 14 will contact such stop means and thus position the two rod members in the desired telescoped relationship.

The stop means may take a number of forms, but it has been found particularly desirable to have such stop means take the form of an inwardly extending dap or dimple 80 in the partial rear walls of the first rod member 12 which dap or dimple 82 downwardly deflects a portion of each partial rear wall and enables those portions of the partial rear walls of the second rod member 14 at the forward or open end 18 to abut or contact these downwardly deflected wall portions of the dimple and thus achieve the desired stop action and the proper telescoped relationship. This form of stop means is particularly desirable since such dap or dimple is part of the standard roll forming procedure in bending the leg 24 (as well as the leg 25) to its generally 90 degree rearwardly extending position in the final construction configuration of the first rod member. Thus by providing the dap or dimple in the first rod member as a preliminary step before the rod members are telescoped, the dap or dimple provides the stop means and also ensures that thereafter the shrink wrapped package will be of a more desirable and useful configuration as hereinafter will be more clearly brought out.

Figure 6A:
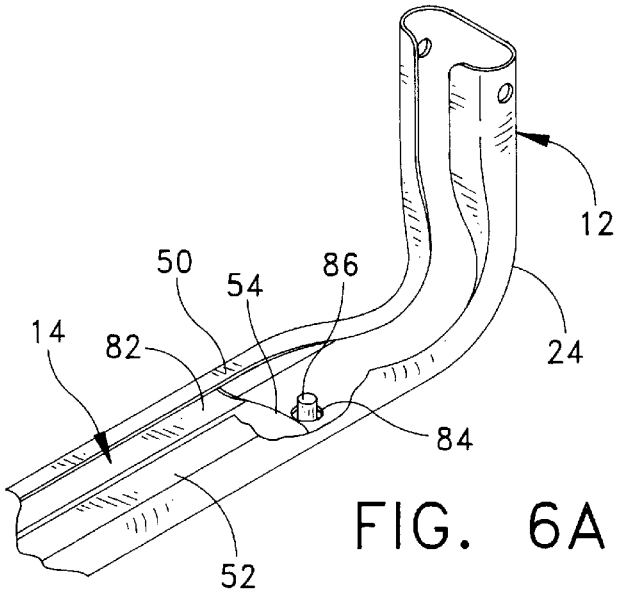
FIG. 6A is a partial view of a portion of FIG. 6 but showing another form of stop means.
Figure 6B:
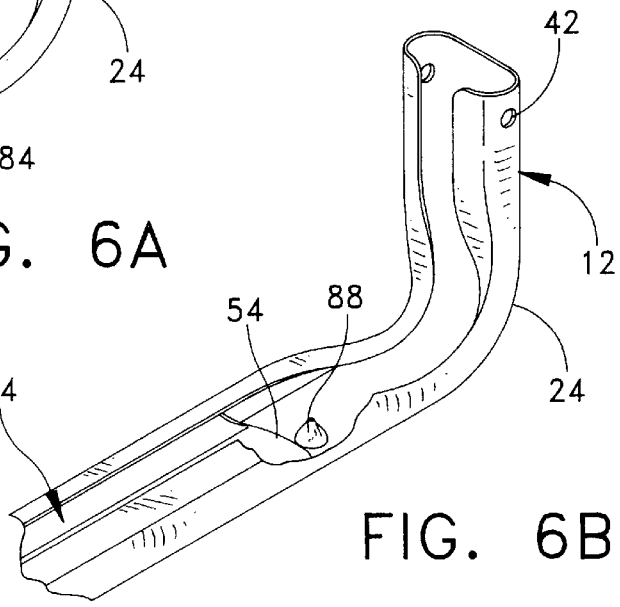
FIG. 6B is a partial view of a portion of FIG. 6 but showing still another form of stop means.
Figure 6:
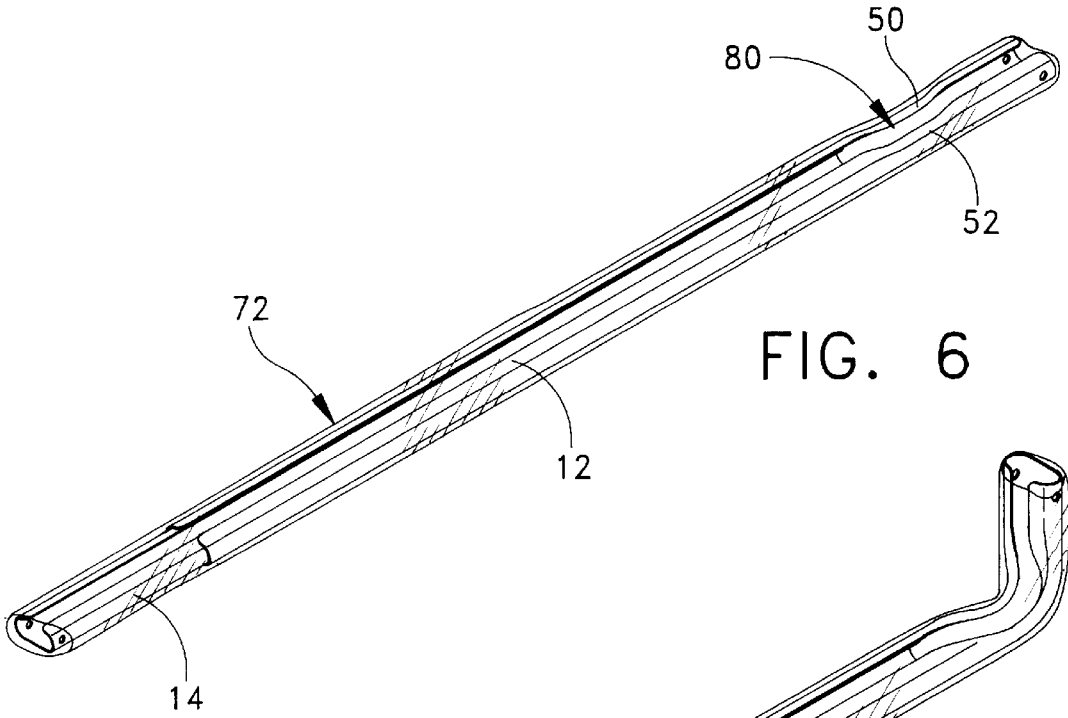
FIG. 6 shows the rod members of FIG. 5 in telescoped condition and provided with a plastic heat shrunk covering or skin prior to the opposite ends being formed into rearwardly extending legs and also showing a stop means for positioning the rod members to the desired position relative to each other.
Figure 7:
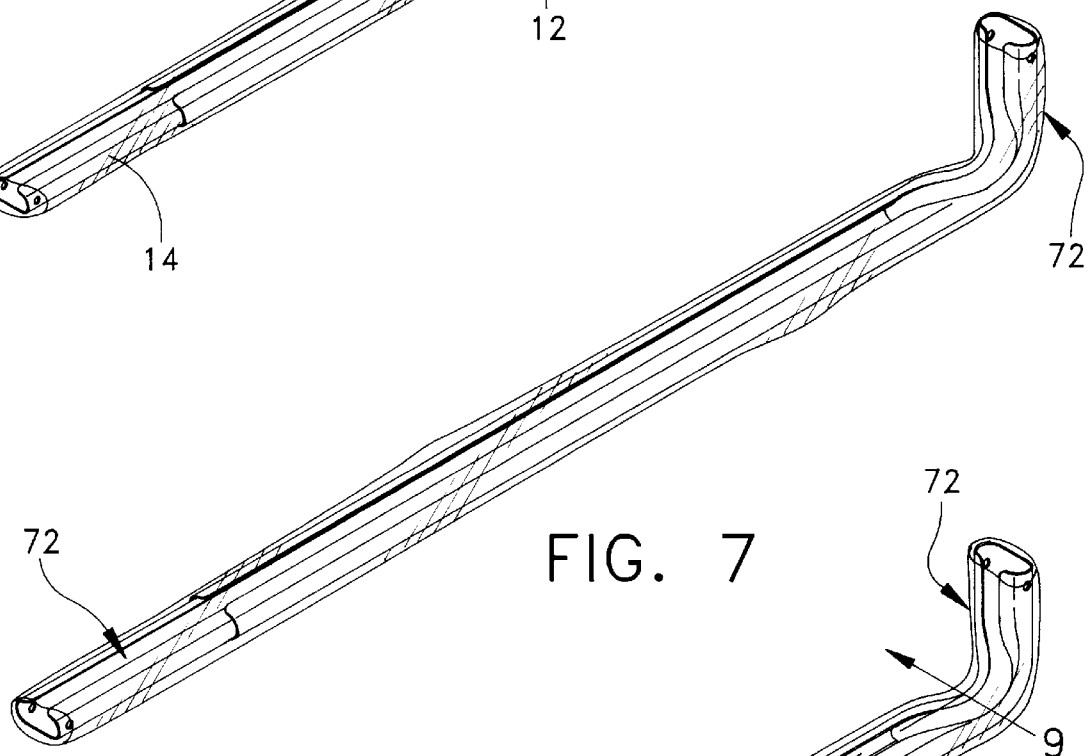
FIG. 7 shows the outer rod member outer end formed into a leg.
Figure 8:
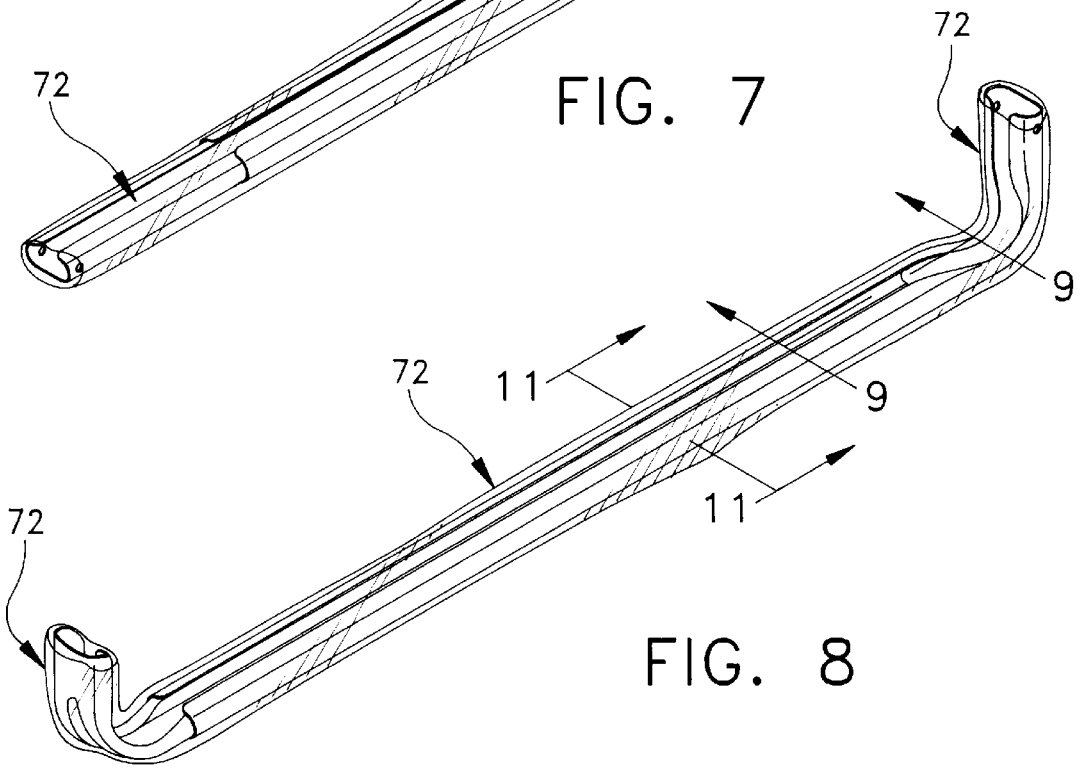
FIG. 8 shows the formation of the leg of the inner rod member.
Figure 9:
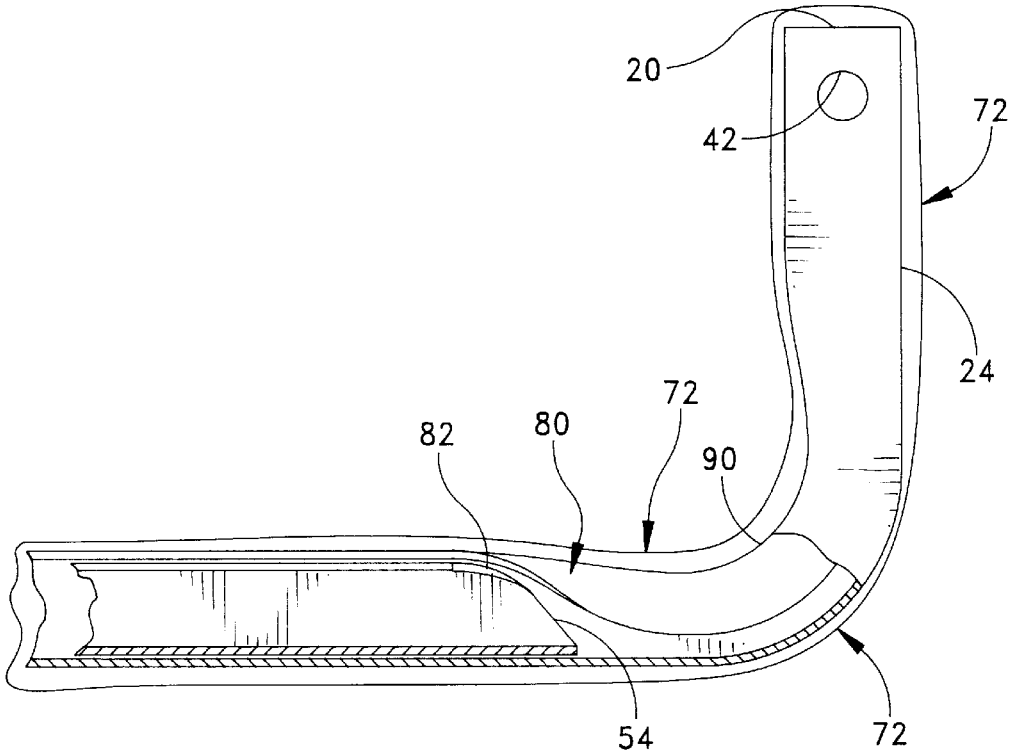
FIG. 9 is a sectional view along the line 9—9 of FIG. 8.
Figure 10:
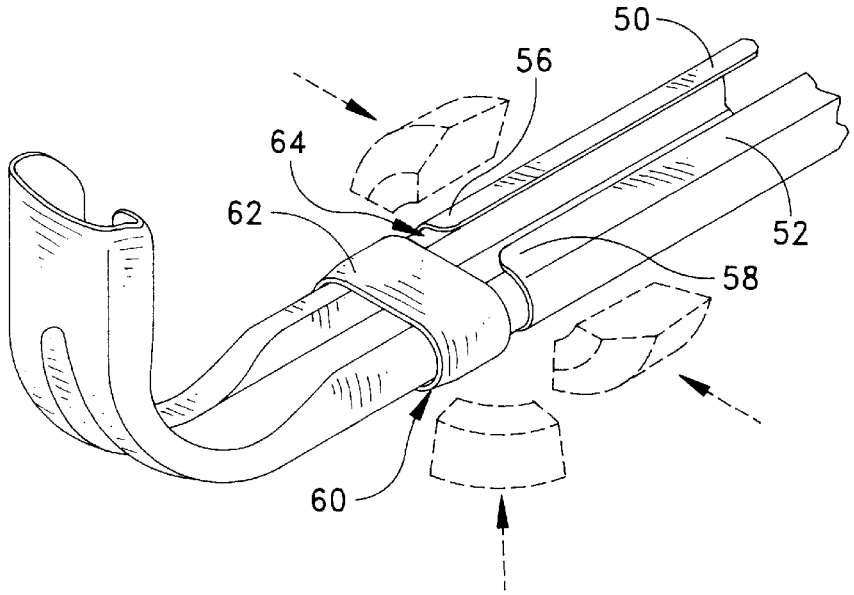
FIG. 10 is an enlarged partial view showing the manner in which portions of a roll former may engage the free open end of the first member of the curtain rod to, in effect, more closely dap or extend such into conformity with the underlying portions of the telescoped second member of the rod.
Figure 11:
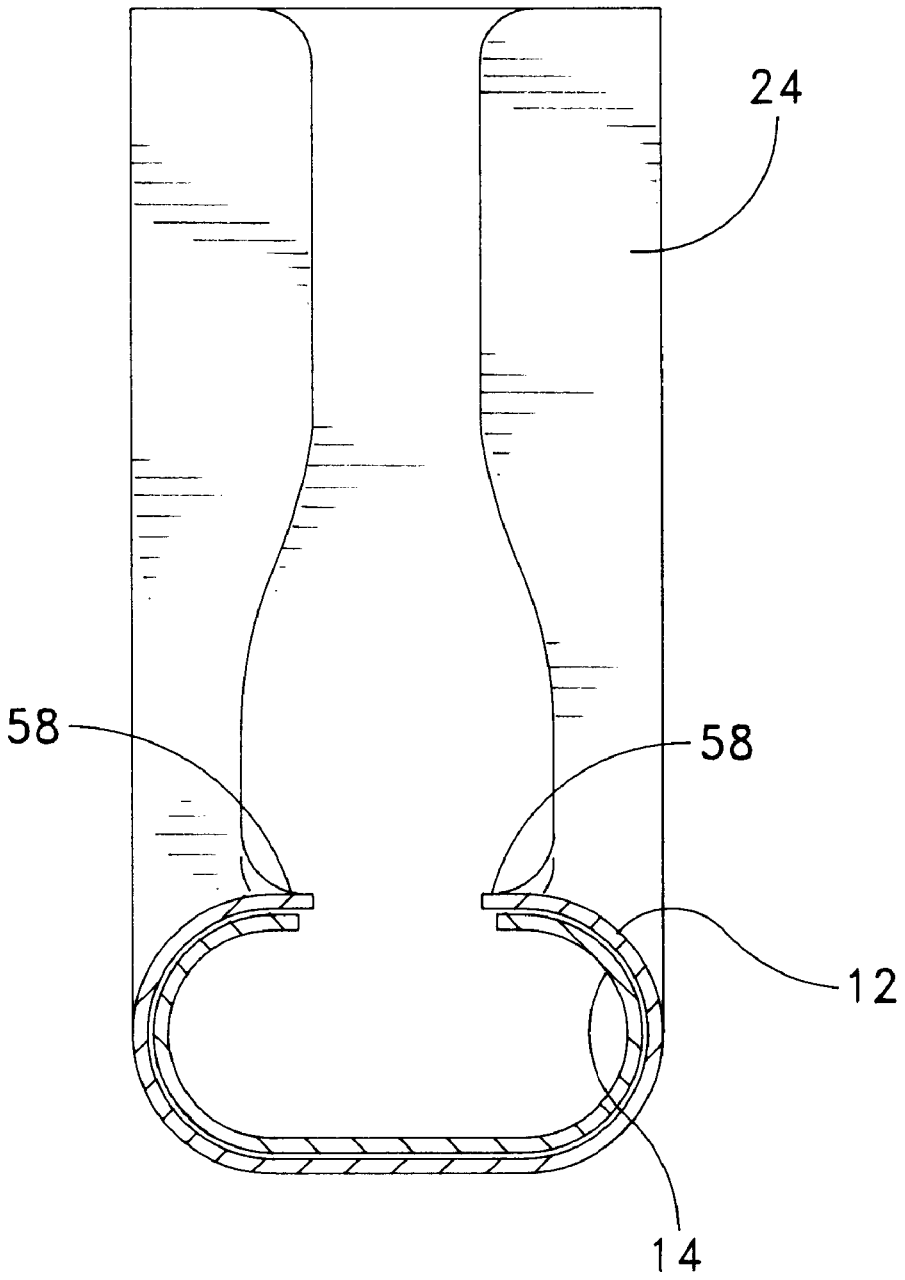
FIG. 11 is a cross-sectional view along the line 11—11 of FIG. 10 illustrating this close conformity.

It should be mentioned that other stop means may be utilized including, for instance, punching a hole 84 in the front wall of the first rod member 12 and then placing a pin or button 86 therethrough such that the pin or button would contact the forward or leading edge 54 of the open end 18 of the second rod member 14 as shown in FIG. 6A. Alternatively, a small mound of plastic resinous material could be adhered to the inner or rear surface of the front wall of the first rod member 12 also but in abutting contact with the forward edge 54 as previously explained and as shown in FIG. 6B.

After the shrink wrap covering 70 has been completed, the thus covered intermediate rod package is fed to a conventional roll former in which the sequential bending of the first leg 24 and then the second leg 25 or vice versa takes place bearing in mind that the package as above described prevents telescoping in the expanded or outward direction, and the stop means as previously explained prevents telescoping in the inward position. Such roll forming equipment generally includes a series of dies to perform progressive forming and bending steps upon the rod and or rod members which are generally horizontally oriented with the rear walls positioned uppermost and may include an upwardly pivotable forward section to bend the legs as well as side action die components to contact the tabs 56 and 58. It should also be pointed out that the stop means prevent intrusion of the forward end of the second rod member from coming in contact with the bending dies of the roll former equipment especially in the preferred form where the preliminary dap or dimple is utilized as the stop means. After the leg 24 is formed, the opposite end of the package is fed to a roll forming machine in which an initial dimple is placed in the partial rear walls of the second rod member 14 simultaneously or as part of the serial forming procedure. Portions of the die forming equipment shown in dotted lines in FIG. 10 may be utilized to forcibly contact the wings 56, 58 from both the sides and rear thereof so that they better conform to the underlying shape of the proximate portion of the second rod telescoped therein either before, during or after the formation of the leg 25 in the aforementioned standard roll forming techniques. During these bending and forming procedures, the plastic envelope or skin merely moves with the rod portions being bent and even helps prevent marring the painted surfaces thereof.

Figure 4:
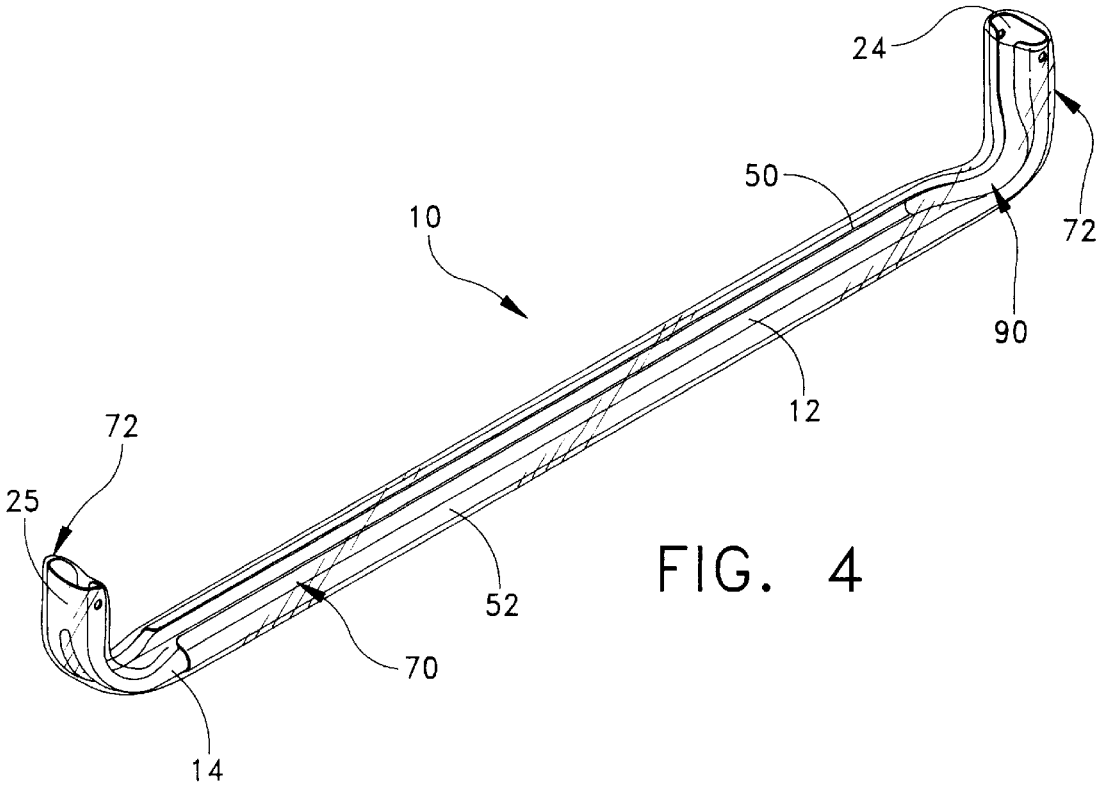
FIG. 4 is a perspective view of a curtain rod packaged in accordance with the packaging concept of the present invention.
Figure 5:
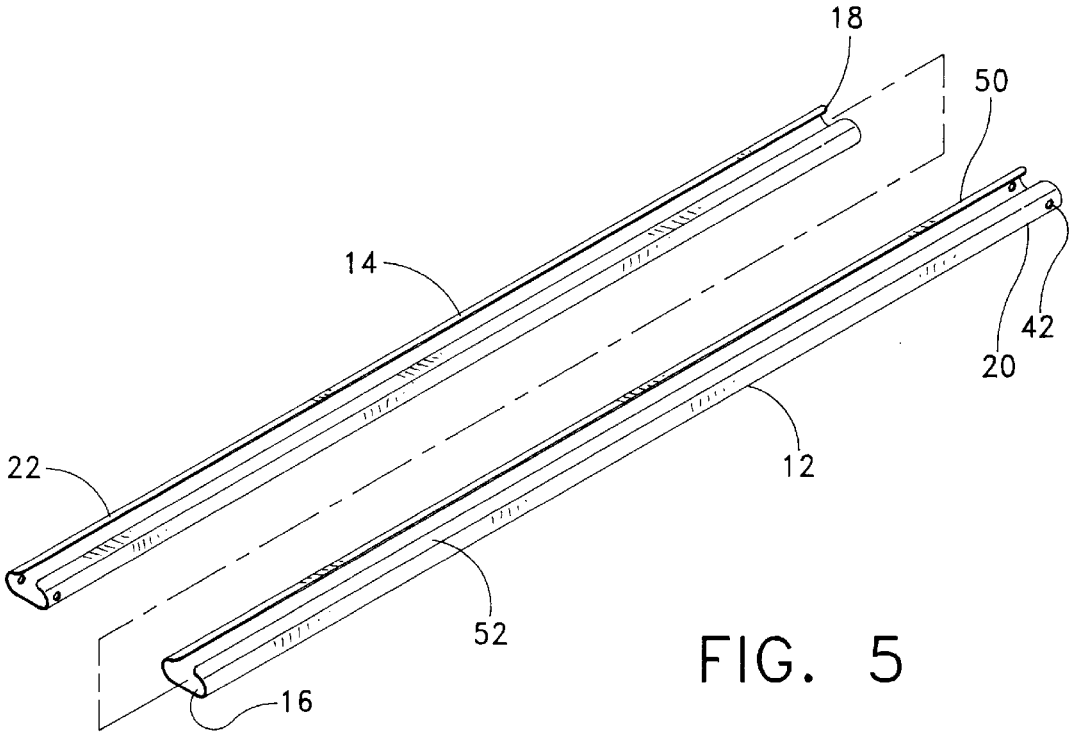
FIG. 5 is a view similar to FIG. 4 but showing the first and second telescoping members of the curtain rod in separated position.
Figure 4A:
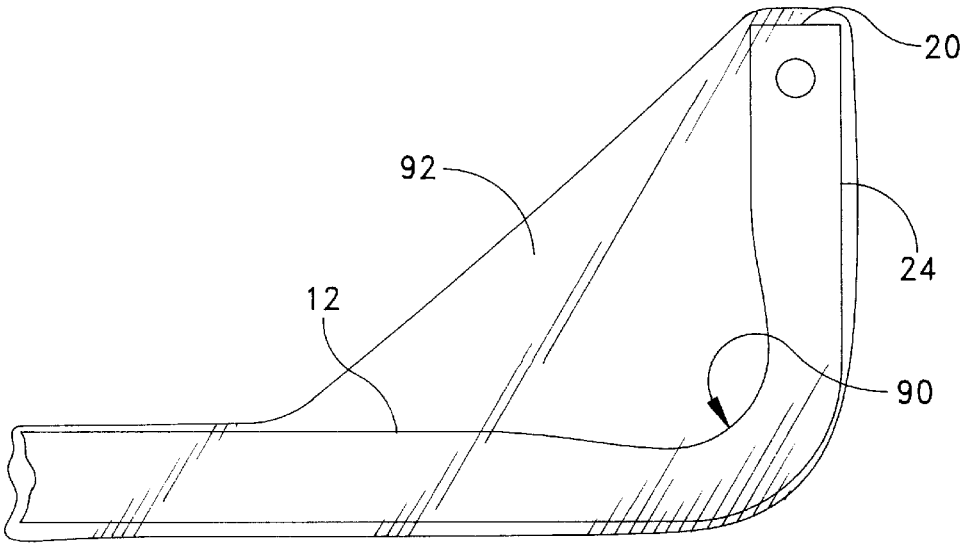
FIG. 4A is a partial view of FIG. 4.

Turning now to FIG. 4 of the drawings, it will be seen that the completed package by reason of the forming technique, that is, the bending of the legs 24 and 25 after the curtain rod 10 has been assembled and packaged in a shrink wrap envelope 70, produces a more desirable package in that the resultant skin covering 72 adheres closely to all the outside surfaces of the curtain rod 10 including the inner curved surfaces 90 of the legs 24, 25, that is, the present package may be characterized as having an absence of the webs 92 shown in FIG. 4A which normally would be present and extend outwardly across such inner curved surfaces 90 from the outer end or terminal end of each leg to the body of its respective rod member if the shrink wrap had been applied as a package material after the curtain rod was in its final bent and ready for use configuration, that is, with legs. These potential material webs are not only undesirable from an aesthetic standpoint, but they place a continual inward force upon the legs 24, 25 and require further packaging material and space; and, accordingly, the procedures used in the present invention not only successfully eliminate such potential drawbacks but do so with further novel features and attendant desirable results.

Figure 12:
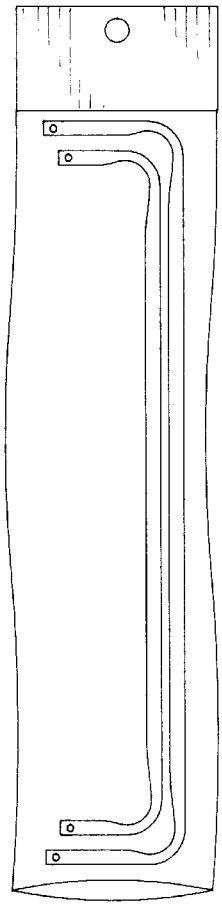
FIG. 12 (PRIOR ART)
FIG. 12 shows a pair of differently sized curtain rods—one for curtains and one for a valance packaged within a conventional loose fitting plastic bag provided with a hanger as is known in the prior art.
Figure 13:
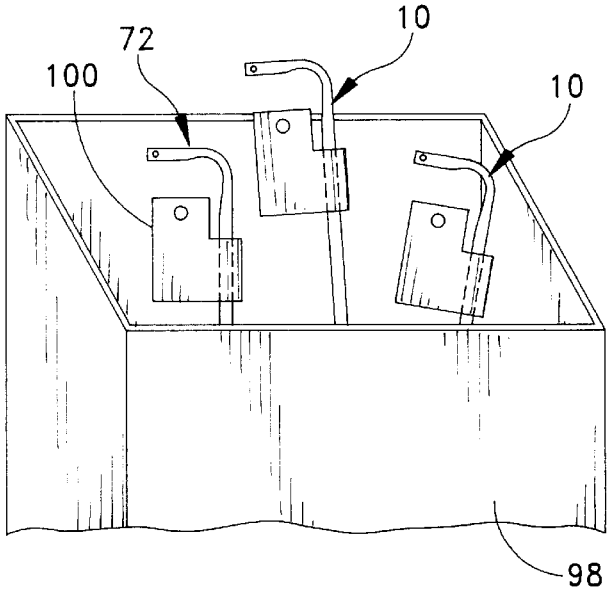
FIG. 13 shows a bin utilized for point-of-purchase display in which one of the uniquely packaged curtain rods of the present invention are shown.
Figure 15:
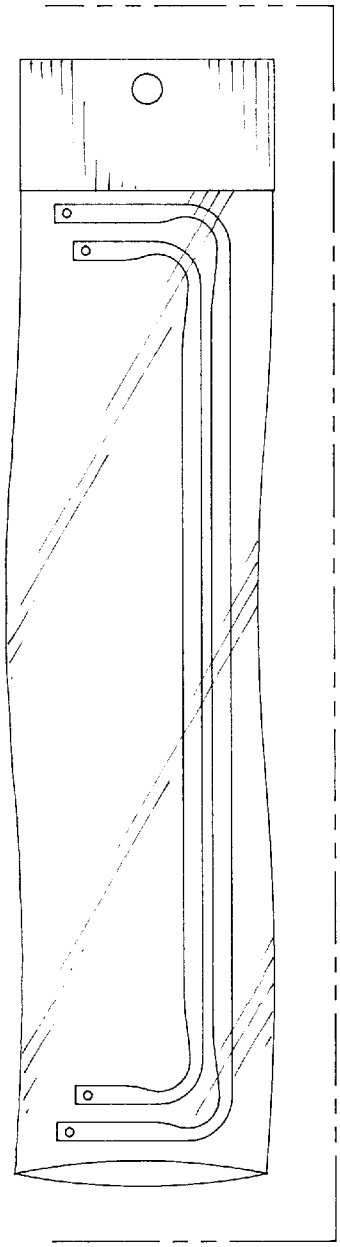
FIG. 15 is a showing of a conventional clear plastic bag enclosing a pair of differently sized curtain rods such as shown in FIG. 12 but presented as being within a shipping carton shown in broken lines.
Figure 16:
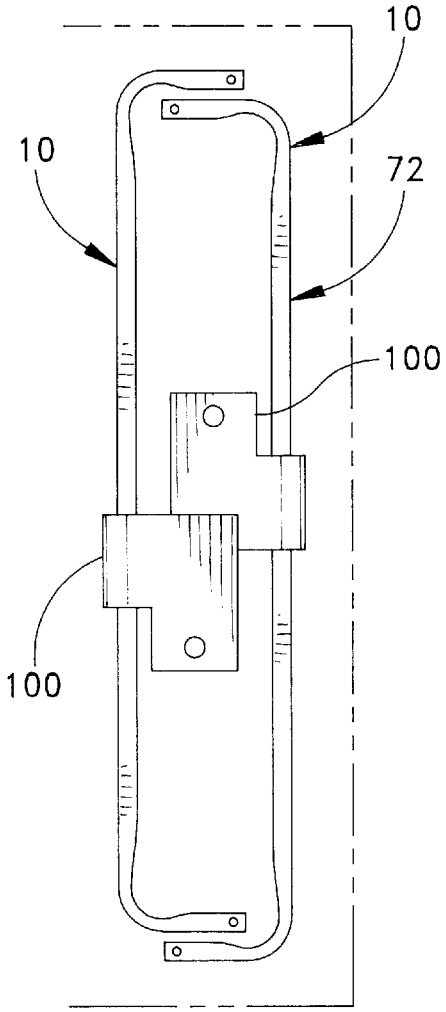
FIG. 16 is a view similar to FIG. 15 but showing the unique package of the present invention disposed within a shipping container to show the need for a lesser length container when compared to the package shown in FIG. 15.

As previously explained, the completed and packaged curtain rod 10 can either be placed for sale in a bin 98 and to identify the curtain rod's size and style and place appropriate advertising material thereon, it is desirable to provide such with a label 100. Such label 100 is preferably positioned intermediate the ends 24 and 25 of the curtain rod to conserve space, provide a more logical location for the customer to read the contents and to reduce breaking and tearing of such label 100. Accordingly, it may be apparent by comparing FIGS. 12 and 13 as well as FIGS. 15 and 16 that not only is a more easily handable package achieved by the present invention but also one that saves at least some space such that slightly smaller shipping containers from the manufacturer to the sales outlet can be achieved. The packages shown in FIGS. 12 and 15 are conventional prior art packages. The package of the present invention is also easier to grasp and the need for packaging differently sized curtain rods in the same package as when a valance treatment is desired is eliminated. Thus the customer can select only the required quantity of curtain rods desired for the final result; and by utilizing the previously described brackets 26, the need for inventorying and producing curtain rods with differently sized leg projections is also eliminated.

In some cases, it is desirable and many merchandisers insist that the package be capable of being alternatively displayed in a conventional hook point-of-purchase display, and in those cases, the label 100 of the present invention is tailored to meet those needs as will hereinafter be apparent.

Figure 14:
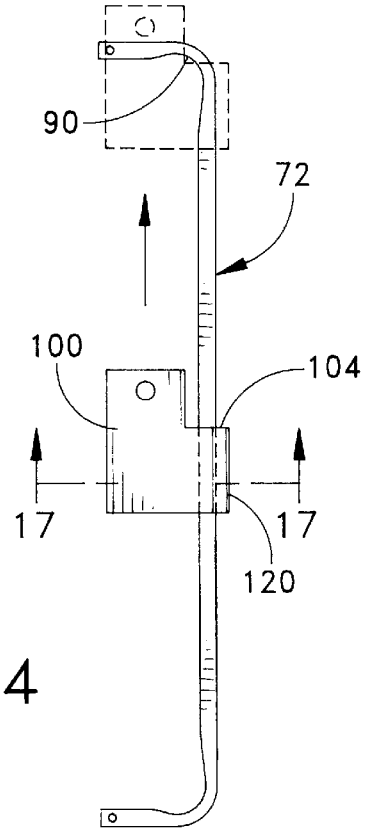
FIG. 14 is an enlarged view of the packaged curtain rod of the present invention showing the manner in which the identification and suspension tag may be provided thereon.
Figure 17:
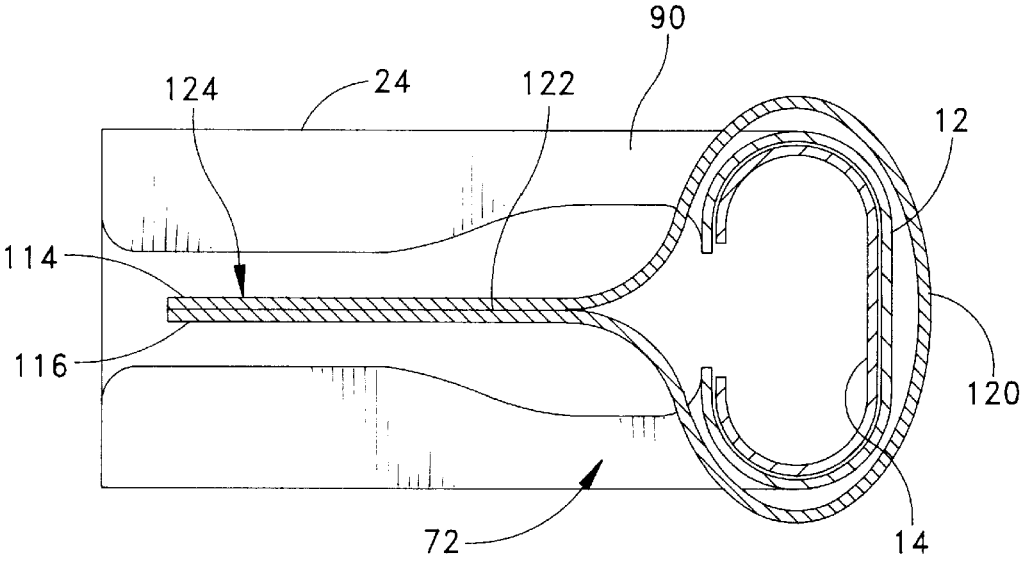
FIG. 17 is an enlarged view taken along the line 17—17 of FIG. 14.
Figure 18:
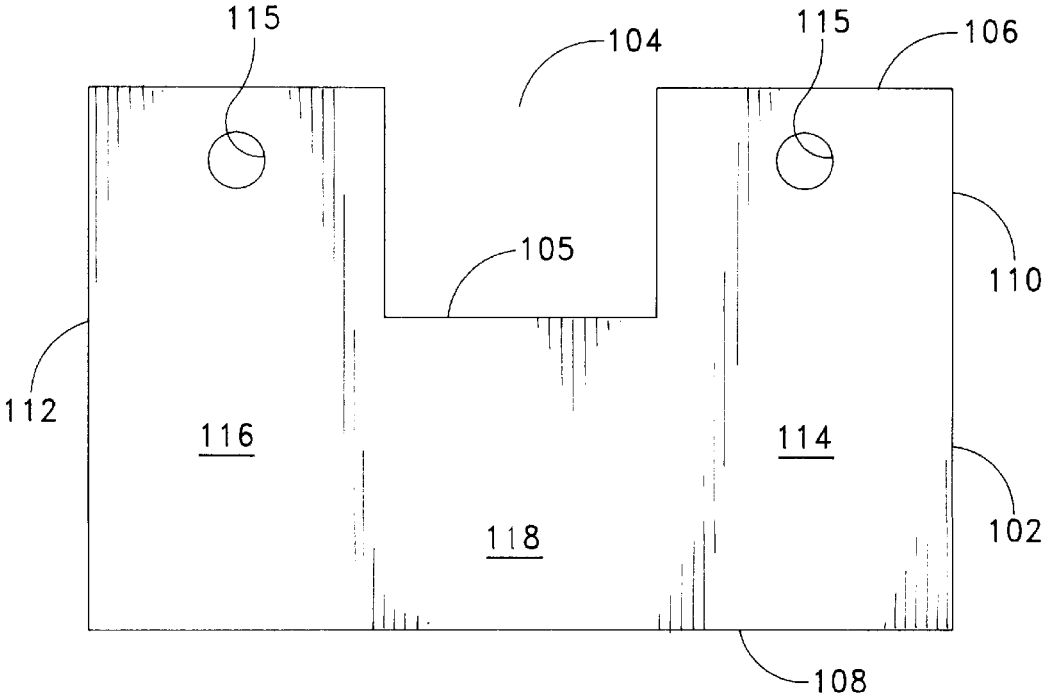
FIG. 18 is a plan view of the blank from which the package tag is formed.

Turning now to FIGS. 14 and 17 in particular, the preferred construction of the label 100 is shown. Normally such label is formed from a coated relatively thick paper or paperboard stock such that graphics can easily be applied to the outer surfaces thereof. As best shown in FIG. 18, the label 100 is formed from such stock from a blank 102 of generally rectangular configuration having a cutout portion or notch 104 extending inwardly from an upper edge 106 thereof while the opposed lower edge 108 is generally unnotched. Such blank 102 is then wrapped around the package intermediate the curtain rod legs such that the side edges 110 and 112 are preferably aligned with each other and the side flaps 114 and 116 are generally superposed upon each other. Such folding or bending action causes the central web 118 which joins the flaps 114 and 116 to, in effect, form a roll or tube 120 surrounding the rod package and then the flaps 114 and 116 are affixed together such as by a staple 122. The tube 120 is large enough so as to be frictionally moved from the solid line position as shown in FIG. 14 to the dotted line position thereabove wherein a portion of the composite panel 124 formed by the side panels 114 and 116 can extend upwardly above either the leg 24 or 25 dependent upon the orientation of the package. Such composite panel 124 is positioned in front or behind either such leg 24, 25 and its position is shown in FIG. 14 slightly to the left thereof by reason of the provision of the notch 104. The upper edge 105 thereof forming the upper edge of the tube 120 which by contact with the inner end of the particular leg limits the upward travel of the label. For this additional reason, the elimination of any web 92 which might be formed by shrink wrapping an already completely formed and assembled curtain rod is again of importance. The panels 114 and 116 are provided with holes 115 which when aligned with each other in the previously described folding technique achieve an opening for receipt of the hook of the peg board display.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A curtain rod and package therefore comprising first and second elongated rod members each having a body including a front wall in turn having opposed rear and front surfaces and at least a partial rear wall respectively upwardly and downwardly extending from bottom and top edges defined by said front wall, said rod members each having first and second laterally opposed ends, said rod members circumferentially sized to enable the longitudinal telescoping of said rod members at said first ends thereof, said second rod member telescoped into said first rod member and said second ends each provided with a generally rearwardly extending leg having inner and outer curved surfaces formed respectively from said at least partial rear wall and said front wall for connecting said leg to its respective rod member, said first rod member including stop means proximate to its respective leg for contact with the first end of said second rod member and a plastic covering shrink wrap enveloping said curtain rod and in close contact with the outside surfaces thereof including said inner curved surfaces.

2. The curtain rod and package of claim 1, wherein the plastic covering is further characterized by the absence of plastic material webs between said inner curved surfaces.

3. The curtain rod and package of claim 1, wherein said stop means comprises a downwardly extending dimple in said at least partial rear wall and extending towards the rear surface of said front wall inwardly proximate the respective leg of said first rod member.

4. The curtain rod and package of claim 1, wherein the plastic covering essentially entirely covers all the exposed outer surfaces of the telescoped rod including the second ends of said rod members which in turn form terminal ends of their respective legs.

5. A curtain rod and package as set forth in claim 1, and further comprising a merchandising tag positioned around the telescoped rod members and plastic covering, said tag having a tube surrounding said curtain rod package at a central position disposed between the rod member legs and a longitudinally extending panel adapted for positioning above one of said legs in an alternate tag position.

6. A method of forming a combination package of a curtain rod and a shrink-wrap plastic covering essentially entirely covering said curtain rod and wherein said curtain rod includes first and second elongated rod members each having a body including a front wall in turn having opposed rear and front surfaces and at least a partial rear wall respectively upwardly and downwardly extending from bottom and top edges defined by said front wall, said rod members each having first and second laterally opposed ends, said rod members circumferentially sized to enable the longitudinal telescoping of said rod members at said first ends thereof, said second rod member telescoped into said first rod member and said second ends each provided with a generally rearwardly extending leg having inner and outer curved surfaces formed respectively from said at least partial rear wall and said front wall for connecting said leg to its respective rod member, said first rod member including stop means proximate to its respective leg for contact with the first end of said second rod member, comprising the sequential steps of providing said stop means in said first rod member, telescoping said second rod member into said first rod member, essentially completely enveloping the thus assembled curtain rod with a plastic film capable of being shrunk, thereafter shrinking said film into close contact with the outside surfaces of said rod and thereafter bending the second ends of said rod members while so enveloped to form said rearwardly extending legs.

7. The method as set forth in claim 6, wherein said second rod member is first positioned in contact with said stop means prior to said bending procedures.

8. The method as set forth in claim 6, wherein said stop means is formed in said first rod member by downwardly dimpling a portion of said at least partial rear wall thereof towards the rear surface of the first rod front wall thereby forming an obstruction to the further telescoping first end of said second rod member and thus thereof with respect to said first rod member said dimpling procedure being a preliminary step to said leg bending.

9. The method as set forth in claim 6, wherein said first rod first end includes terminal tabs, said tabs being inwardly swaged during the bonding formation of the second rod member leg.

10. A label for use with a curtain rod having a central longitudinal body with a forward face wall and a pair of rearwardly extending legs each having an inner curved surface connecting the respective leg to the rod body and disposed at opposed ends thereof, said label including a pair of superposed panels having a composite upper edge and connected by a tube having an upper edge positioned materially below said panel upper edge, said tube surrounding said rod centrally intermediate said legs in a first position and upwardly movable to an alternate position where that portion of the composite panel disposed above said tube upper edge is disposed above and proximate one of said legs and said tube upper edge contacts the inner connecting surface of said one of said legs.

* * * * *